US006836640B2

(12) United States Patent
Isemura et al.

(10) Patent No.: US 6,836,640 B2
(45) Date of Patent: Dec. 28, 2004

(54) SHEET CONVEYING APPARATUS AND IMAGE FORMING APPARATUS

(75) Inventors: Keizo Isemura, Tokyo (JP); Ichiro Sasaki, Ibaraki-ken (JP); Manabu Yamauchi, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/315,028

(22) Filed: Dec. 10, 2002

(65) Prior Publication Data

US 2003/0118385 A1 Jun. 26, 2003

(30) Foreign Application Priority Data

Dec. 12, 2001 (JP) ..... 2001-378121

(51) Int. Cl.[7] ..... G03G 15/00; G03G 21/00

(52) U.S. Cl. ..... 399/388; 271/265.01; 271/270; 399/16; 399/396; 399/401

(58) Field of Search ..... 399/388, 391, 399/394, 396, 361, 401, 16; 271/9.02, 9.13, 256, 258.01, 259, 265.01, 265.02, 270

(56) References Cited

U.S. PATENT DOCUMENTS 5,132,742 A * 7/1992 Goto ..... 399/401
5,449,164 A * 9/1995 Quesnel et al. ..... 271/270
6,094,561 A * 7/2000 Ushio ..... 399/401
6,332,608 B1 12/2001 Tamura ..... 271/111
6,419,222 B1 * 7/2002 Morrison et al. ..... 271/265.01
6,681,096 B2 * 1/2004 Seto et al. ..... 399/388
2002/0051665 A1 * 5/2002 Seto et al. ..... 399/388

FOREIGN PATENT DOCUMENTS

| | | | |
|---|---|---|---|
| JP | 05-238590 | * | 3/1993 |
| JP | 08-067390 | * | 3/1996 |
| JP | 11-171395 | * | 6/1999 |
| JP | 2000-211756 | | 8/2000 |

* cited by examiner

*Primary Examiner*—Sophia S. Chen
(74) *Attorney, Agent, or Firm*—Fitzpatrick, Cella, Harper & Scinto

(57) ABSTRACT

A sheet conveying apparatus has a first conveying unit for conveying a sheet, a second conveying unit for conveying a sheet in merging with the first conveying unit and a sheet merging overlapping device. At a junction between the first and second conveying unit, the sheet merging overlapping device overlaps the sheet conveyed by first conveying unit with the sheet conveyed by the second conveying unit in a sheet conveyance direction.

13 Claims, 10 Drawing Sheets

FIG.10

| roller mark | types of the bearings | roller material | mechanical structure of the roller drive | existence of the electromagnetic brakes |
|---|---|---|---|---|
| R100 | sintered bearing | rubber | conveyance mechanism | not equipped |
| R101 | sintered bearing | rubber | conveyance mechanism | not equipped |
| R102 | bearing | rubber | conveyance mechanism | not equipped |
| R103 | bearing | rubber | conveyance mechanism | not equipped |
| R104 | sintered bearing | rubber | conveyance mechanism | equipped |
| R105 | sintered bearing | rubber | conveyance mechanism | not equipped |
| R106 | sintered bearing | rubber | conveyance mechanism | not equipped |
| R107 | bearing | sponge | conveyance mechanism | not equipped |
| R108 | | rubber | separation mechanism | not equipped |
| R109 | | rubber | separation mechanism | not equipped |
| R110 | | rubber | separation mechanism | not equipped |
| R111 | | rubber | separation mechanism | not equipped |
| R112 | | rubber | separation mechanism | not equipped |
| R113 | sintered bearing | rubber | conveyance mechanism | not equipped |
| R114 | sintered bearing | rubber | conveyance mechanism | equipped |
| R115 | sintered bearing | rubber | conveyance mechanism | equipped |
| R201 | sintered bearing | rubber | conveyance mechanism | not equipped |
| R202 | | rubber | separation mechanism | not equipped |

SHEET CONVEYING APPARATUS AND IMAGE FORMING APPARATUS

BACKGROUND OF THE INVENTION

1. Field of the Invention

This invention relates to a sheet conveying apparatus used for a photocopier, printer, facsimile machine, or hybrid machine which is a combination of the aforementioned machines and to an image forming apparatus having the sheet conveying apparatus.

2. Description of Prior Art

An electrophotographic photocopier as an example of conventional image forming apparatuses is structured to correct oblique feeding of sheets by striking a nipping portion of a register roller, the sheets fed from a sheet supplying section to an image forming section while the register roller arranged right before the photosensitive drum of the image forming section is stopped.

In a photocopier having a long conveyance route from the sheet supplying section to the image forming section, a subsequent sheet is fed one by one without awaiting image formation on a proceeding sheet at the photosensitive drum in order to render higher the productivity of the photocopier. Plural sheets therefore exist in the conveyance route from the sheet supplying section to the image forming section.

Because the sheet is substantially stopped at a position of the register roller at a timing correcting oblique feeding of the sheets, the subsequent sheets are temporarily stopped at a sheet interval in accordance with that stoppage so that the subsequent sheets do not catch up to this sheet. Then, the plural sheets in the conveyance route are controlled to resume being fed by driving at the same time the register roller located right before the photosensitive drum and the rollers located from the sheet supplying section to the photosensitive drum in association with the timing of image rotation on the photosensitive drum. The register roller feeds the sheet to the photosensitive drum, and the register roller is stopped after the rear end of the sheet passes the register roller to prepare for arrival of the subsequent sheet.

As one means for conveying sheets with remarkably short sheet intervals in the conveyance route from the sheet supplying section to the register roller, and as disclosed in Japanese Pre-Granted Publication (A1) No. 2000-211,756, there is an apparatus that feeds sheets such that the rear end of the proceeding sheet and the front end of the subsequent sheet are partly overlapped when the sheets are fed subsequently from the feeding cassette to the image forming section.

It is desirable to improve further the productivity of such a conventional photocopier, and to do so, it is necessary to increase the conveyance speed or to reduce the sheet interval. Even using the apparatus shown in Japanese Pre-Granted Publication (A1) No. 2000-211,756 in which the sheets are fed upon overlapping the sheets from the feeding cassette, the sheet overlapped feeding cannot satisfy the demand because feeding is made alternatively from the cassette feeding and the double side feeding when images are formed on the double sides.

Higher productivity when duplex printing is becoming expected as the apparatus feeding sheets faster, and very sensitive timing is required to merge the sheets in keeping the sheet interval constant at the junction of the sheets from the double side section and the cassette.

SUMMARY OF THE INVENTION

This invention is for a sheet conveying apparatus comprising: a first conveying means for conveying a sheet; a second conveying means for conveying a sheet in merging with the first conveying means; and a sheet merging overlapping means for overlapping, at a junction between the first and second conveying means, the sheet conveyed by the first conveying means with the sheet conveyed by the second conveying means in a sheet conveyance direction.

This invention is also for a sheet conveying apparatus comprising: a first conveyance route for guiding a sheet conveyed by a first conveyance roller for conveying the sheet; a second conveyance route for guiding a sheet conveyed by a second conveyance roller for conveying the sheet; and a controller for controlling the drive and stop of the first and second conveyance rollers, wherein the first conveyance route and the second conveyance route are merged, and wherein the controller so controls the drive and stop of the first and second conveyance rollers as to convey the sheets in overlapping, at a junction between the first and second conveyance routes, the proceeding sheet guided by one of the first and second conveyance routes with the subsequent sheet guided by the other in a sheet conveyance direction.

This invention is further for a sheet conveying apparatus comprising: a first conveyance route for guiding a sheet conveyed by a first conveyance roller; and a second conveyance route for guiding a sheet conveyed by a second conveyance roller in merging the first conveyance route, and having an overlapping conveyance mode for conveying the sheets in overlapping the proceeding sheet guided by one of the first and second conveyance routes with the subsequent sheet guided by the other in a sheet conveyance direction, and an overlapping canceling mode for canceling the conveyance overlapping the proceeding sheet with the subsequent sheet and separating the proceeding sheet from the subsequent sheet.

BRIEF DESCRIPTION OF THE DRAWINGS

FIG. 10 is a table showing structures of bearings of respective conveyance rollers and the register roller.

DESCRIPTION OF PREFERRED EMBODIMENTS

Figure 1:
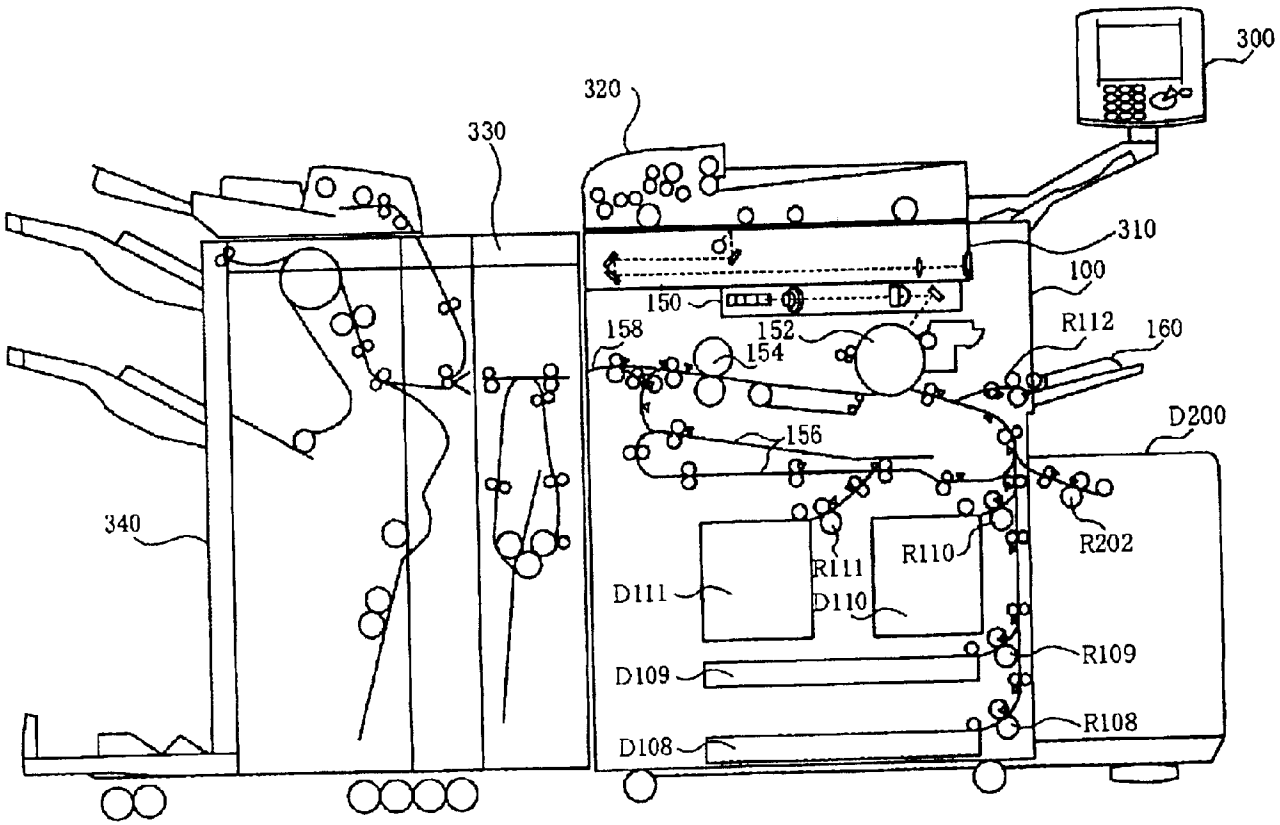
FIG. 1 is an illustration showing an image forming apparatus according to an embodiment of the invention.

FIG. 1 shows an image forming apparatus according to an embodiment of the invention. This image forming apparatus is structured to have printer section 100, an optional feeding deck D200, a controlling portion 300, a scanner 310, an original document feeder 320, a sheet folding device 330, and a finisher 340, etc. The printer section 100 forms, in a way of an electrophotographic method on sheets, original document images read by the scanner 310 and images received through a network.

The original document feeder 320 and the controlling portion 300 are arranged at an upper portion of the printer section 100, and the original document feeder 320 automatically feeds the original documents to a reading position of the scanner 310, thereby rendering the scanner 310 read the original documents one by one. The controlling portion 300 performs input operations for setting the image forming apparatus and indication of the status of the image forming apparatus.

The optional feeding deck D200 serving as a sheet containing means, and a sheet post-treatment apparatus are arranged at aside of the printer section 100. The optional feeding deck D200 includes a large volume sheet mounting portion and is attached to the printer section 100 according to the user's necessity.

The sheet post-treatment apparatus includes the sheet folding device 330, and the finisher 340. The sheet folding device 330 can fold sheets in A3 (Japanese standard) size into a Z-letter folded shape. When no folding is set at the controlling portion 300, the sheets are fed to the finisher 340 located on a downstream side without folding treatment on the sheets. The finisher 340 is a paper delivery section having plural delivery trays and also a sheet finishing section performing stapling operation or the like on the sheets. The finisher 340 delivers the sheets conveyed from the upstream side to the delivery trays upon, e.g., sorting and stapling the sheets.

A laser light emitting portion 150 in the printer section 100 emits laser beam to a photosensitive drum 152 in accordance with the images from the scanner 310 or images received from the network. Latent images are formed on the photosensitive drum 152 according to radiation of the laser beam, and toner images are formed on the photosensitive drum 152 upon development in use of toner. The toner images on the photosensitive drum 152 are transferred to the conveyed sheets. The toner transferred on the sheet is fixed onto the sheet by a fixing roller 154. The sheet passed over the fixing roller 154 is fed by way of the delivery path 158 to the sheet folding device 330 located on the downstream side or to the photosensitive drum 152 again upon reversing the side by means of a double side path 156 to form images.

Feeding cassettes D108, D109 and feeding decks D110, D111 serving as a sheet containing means and containing sheets are formed at the printer section 100, and a manual feeding portion 160 is provided on a side of the apparatus body. The sheets can be selectively fed from the respective cassettes, decks, and the manual feeding portion, and furthermore, the sheets can be fed from the optional feeding deck D200.

Figure 2:
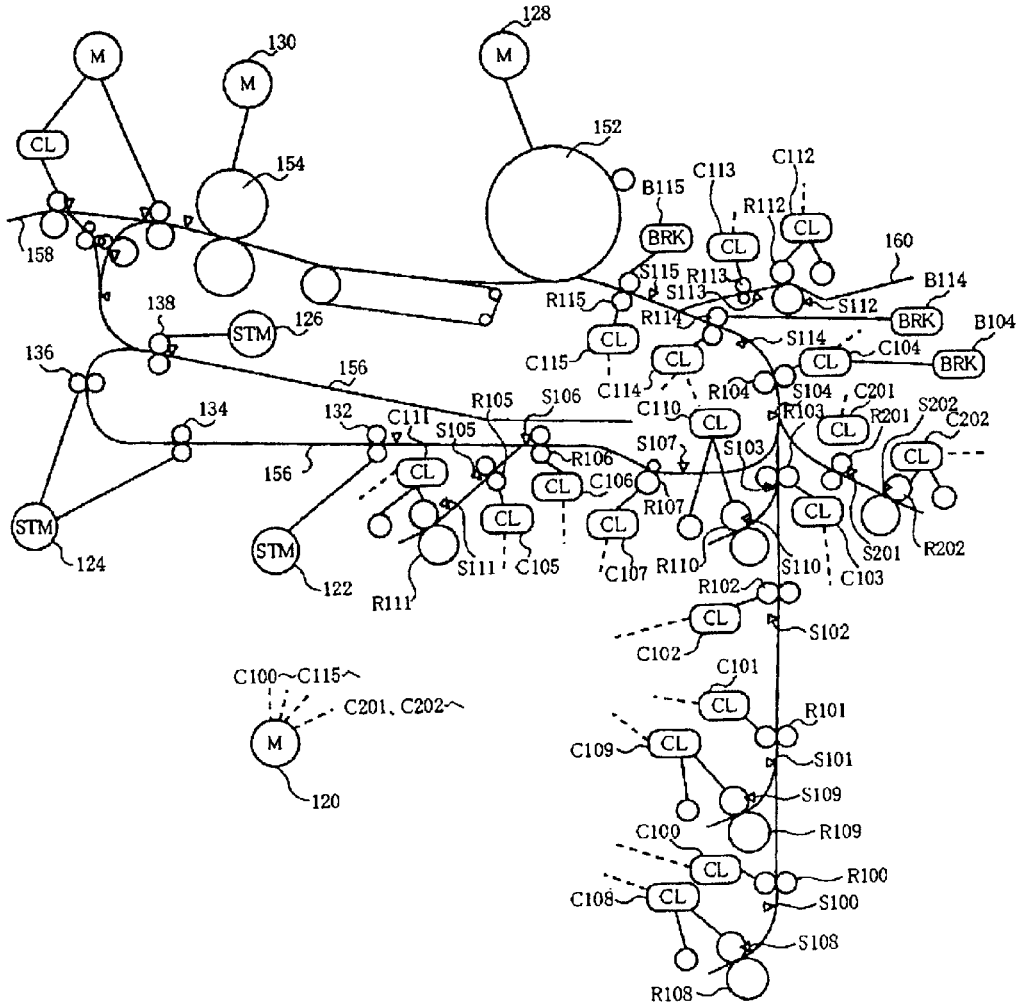
FIG. 2 is an illustration showing a structure of sheet conveyance in a printer section.

FIG. 2 shows a structure for sheet conveyance in the printer section 100. The sheet stacked on the feeding cassette D108 is picked up by the roller R108 and is fed upon separation from the sheets other than the topmost sheet. The sheet is conveyed to the photosensitive drum 152 by the respective conveyance rollers R100, R101, R103, R104, R114 and the register roller R115 as a registering means of the invention.

The sheet fed out of the feeding cassette D109 by the roller R109 is similarly conveyed to the photosensitive drum 152 by the respective conveyance rollers R100, R101, R103, R104, R114 and the register roller R115.

The sheet fed out of the feeding deck D110 by the roller R110 is conveyed to the photosensitive drum 152 by the respective conveyance rollers R103, R104, R114 and the register roller R115. The sheet fed out of the feeding deck D111 by the roller R111 is conveyed to the photosensitive drum 152 by the respective conveyance rollers R105, R106, R107, R104, R114 and the register roller R115.

The sheet fed out of the manual feeding portion 160 by the roller R112 is conveyed to the photosensitive drum 152 by the conveyance rollers R113 and the register roller R115. The sheet fed out of the optional feeding deck D200 by the roller R202 is conveyed to the photosensitive drum 152 by the respective conveyance rollers R201, R104, R114 and the register roller R115.

The sheet fed from the feeding section such as the feeding cassettes D108, D109, the feeding decks D110, D111, the manual feeding portion 160, the optional feeding deck D200, and the double side path 156 may be fed obliquely, sheet's oblique feeding is corrected by hitting the sheet to the register roller R115 while the register roller R115 serving as the registering means is stopped.

To increase the productivity of the image forming apparatus, subsequent sheets are fed one by one without waiting image formation made by the photosensitive drum 152 on the proceeding sheet. Therefore, plural sheets exist in the conveyance route from the feeding portion to the photosensitive drum 152. The sheet hit by the register roller R115 is substantially in a stop state, so that the subsequent sheets are temporarily stopped in following this stoppage so as not to catch up the present sheet.

The conveyance rollers R100 to R115, R201, R202 are driven with a motor 120 via clutches C100 to C115, C201, C202. The motor 120 is a DC motor, and the drive force of the motor 120 is transmitted to the rollers upon engagement (or turning on) of the clutch, whereas the drive force of the motor 120 is not transmitted to the rollers upon disengagement (or turning off) of the clutch.

Electromagnetic brakes are provided to the conveyance rollers R104, R114, and the register roller R115, respectively. The conveyance rollers R104, R114, and the register roller R115 can be instantly stopped by disengagement of the clutches C104, C114, C115 corresponding to the rollers as well as turning-on control of the electromagnetic brakes B104, B114, B115.

The conveyance rollers R100 to R103, R105 to R113, R201, R202 do not have any electromagnetic brake, and the rollers are stopped solely by disengagement of the respective clutches. The image forming apparatus can be produced with lower costs since those rollers have no electromagnetic brake. The roller is stopped rotating by frictions at the roller bearings and frictions at contact portions of the roller pair when the clutch is disengaged. The friction at the contact portions of the roller pair is determined by the material of the roller. The roller rotation amount from the clutch disengagement to the roller stop, or namely the sheet advance amount up to the sheet stop is made different according to various factors such as frictional force of the roller bearing, the mechanical structure of the roller, the material of the roller, individual differences among the rollers, etc. When one sheet is clamped by plural various rollers, the rollers interfere with each other to differentiate the sheet advance amount from the clutch disengagement to the sheet stop.

FIG. 10 shows types of the bearings, roller material, mechanical structure of the roller drive, and existence of the electromagnetic brakes of the respective conveyance rollers and the register roller R115. The conveyance rollers R100, R101, R105, R106, R113, R201 are made of a rubber roller supported with sintered bearings having no electromagnetic brake. The conveyance rollers R102, R103 are rubber rollers supported with the bearings having no electromagnetic brake. The conveyance roller R107 is a sponge roller supported with the bearings having no electromagnetic brake. The conveyance R107 conveys sheets and takes out curling of the sheets. The conveyance rollers R108, R109, R110, R111, R112, R202 are separation rollers made of a rubber roller, and those rollers have a mechanical structure in which one of the roller pair rotates in a feeding direction whereas the other of the roller pair rotates in the reverse direction to the feeding direction to separate a sheet from others.

The conveyance rollers R104, R114 and the register roller R115 are a rubber roller supported with sintered bearings having the electromagnetic brakes B104, B114, B115, respectively. The register roller R115 is formed with the electromagnetic brake B115 to stop instantly the rotation of the rollers after the rear end of the sheet goes by the roller because the register roller has to be stopped when the subsequent sheet fed with a small interval arrives after the proceeding is sent. The conveyance roller R114 has to be stopped precisely at a point where the sheet is fed in a prescribed amount upon that the sheet hits the register roller R115, and therefore, the electromagnetic brake B114 is provided to stop the roller upon driving in a prescribed period. The conveyance roller R104 is formed with the electromagnetic brake B104 to instantly stop the roller upon driving the roller in a prescribed period so that the sheets fed in an overlapped manner are to be separated as described above.

The rollers formed with no electromagnetic brake are stopped rotating by disengagement of the clutches. The rubber roller supported by bearing takes longer time from disengagement of the clutch to stop of the roller rotation; the sponge roller supported with the bearings takes time next to the above but more than the rubber roller supported with the sintered bearings; the separation roller having the separation mechanism stops in the shortest period.

Arranged near the conveyance rollers R100 to R115, R201, R202 are respective sensors S100 to S115, S201, S202. Sensors S115, S114 are formed on an upstream side of the photosensitive drum 152. The sensor S115 is for taking the timing to stop the roller when the sheet is conveyed in a prescribed amount after the front end of the sheet hits the nipping portion of the register roller R115. The sensor S114 is for taking the timing to form the latent images on the photosensitive drum 152 by the laser emitting portion 150.

Figure 8:
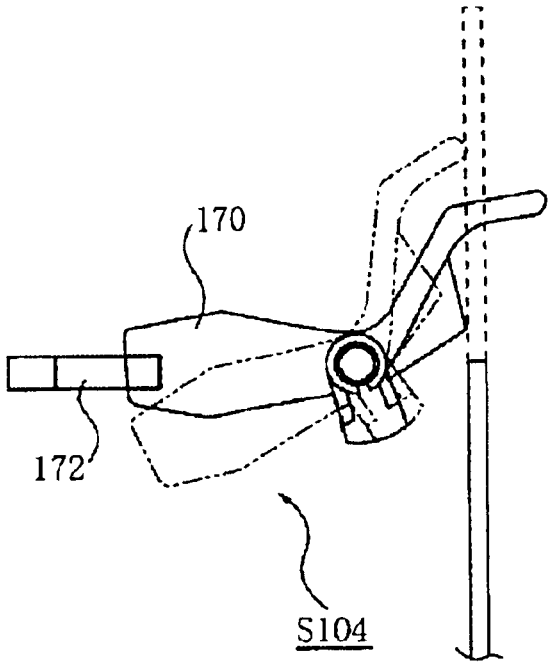
FIG. 8 is a diagram showing a structure of a flag type sensor.

The sensors S102, S106, S107, S104, S114, S115, S112, S113 are flag type sensors made of, as shown in FIG. 8, a movable flag 170 and a light emitting portion and a light receiving portion 172 provided at the movable range of the flag. The sensors are so structured that the sheet pushes down the flag 170 (movable member) when the sheet to be conveyed goes by the sensor. When the flag 170 is disturbing the light path between the light emitting portion and the light receiving portion, or when the flag 170 is not pushed down by any sheet (or namely, when the flag is located at the first position), a judgment is made as there is no sheet. When the flag 170 is not disturbing the light path between the light emitting portion and the light receiving portion 172, or when the flag 170 is pushed down by a sheet (or namely, when the flag is located at the second position), a judgment is made as there is a sheet. Thus, the front end of the sheet and the existence of the sheet is detected by detection as to whether the flag 170 is disturbing the light path between the light emitting portion and the light receiving portion 172.

The flag 170 is urged to be in a solid line state by a spring. When the rear end of the sheet goes by the flag, the flag 170 returns to disturb the light path between the light emitting portion and the light receiving portion 172, but the flag 170 does not return instantly and produce a time lag to return, and therefore, it is difficult to detect the rear end of the sheet precisely. Because the flag type sensors, thus, are not suitable for precise detection of the rear end of the sheet, optical sensors are used for sensors S108, S100, S109, S101, S110, S102, S111, S105 located adjacent to the conveyance rollers R108, R109, R110, R111 for detecting the rear end of the proceeding sheet to create a precise sheet interval during feeding.

Figure 9:
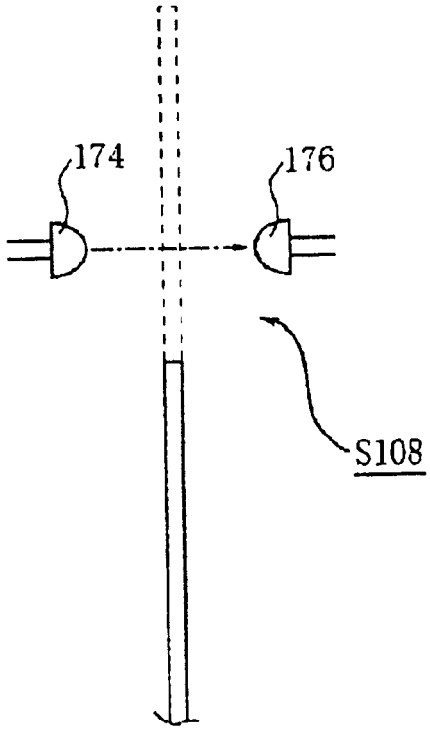
FIG. 9 is a diagram showing a structure of an optical sensor.

The sensors S108, S100, S109, S101, S110, S102, S111, S105 are the optical sensors made of a light emitting portion 174 and a light receiving portion 176 as shown in FIG. 9. When the sheet to be conveyed goes by the sensor, a judgment is made upon detecting as to whether the sheet disturbs the light path between the light emitting portion 174 and the light receiving portion 176, thereby detecting the front end and the rear end of the sheet, as well as existence of the sheet.

The photosensitive drum 152 is driven by a motor 128, and the fixing roller 154 is driven by a motor 130. The sheet fed to the double side path 156 is conveyed by the conveyance rollers 138, 136, 134, 132. The conveyance roller 138 is driven by a motor 126; the conveyance rollers 136, 134 are driven by a motor 124; the conveyance roller 132 is driven by a motor 122. The motors 126, 124, 122 are stepping motors. The motors necessarily rotate in normal and reverse directions in the double side path 156 to switch back the sheet, and stepping motors are used in which the speed can be controlled easily and precisely, to rotate, in the double side path, with a speed matching the fixing roller 154 when receiving the sheet from the upstream side, with a high speed to reduce the sheet interval thereafter, and to stop rotating when the sheet reaches the predetermined location.

Figure 3:
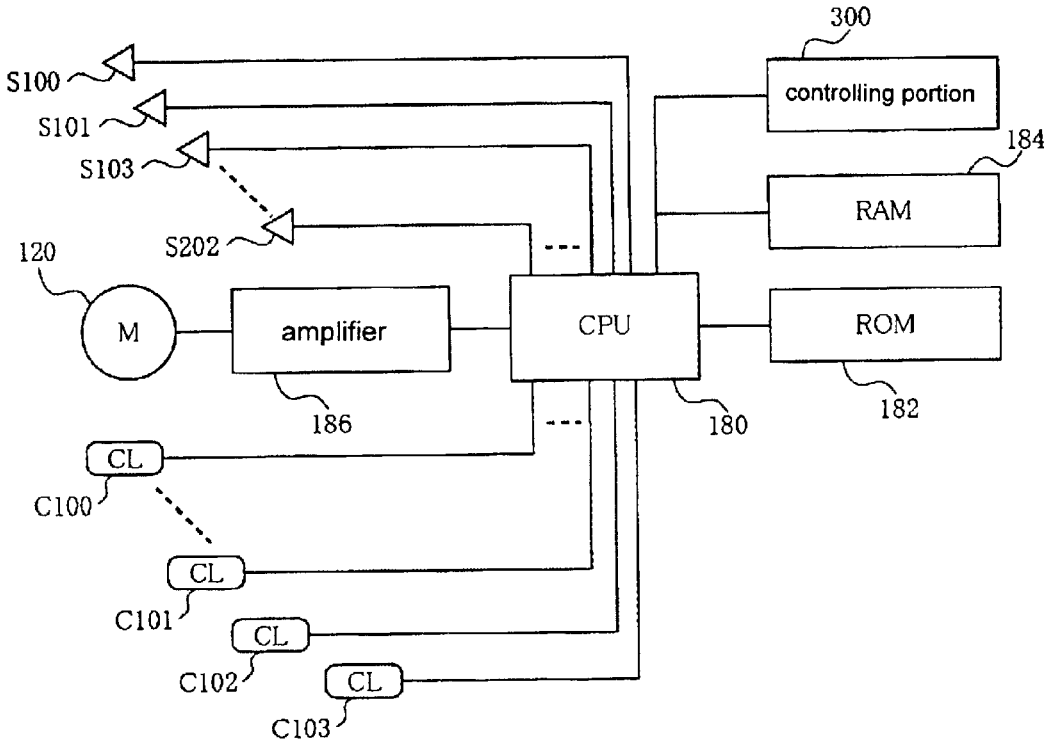
FIG. 3 is a block diagram showing a mechanism of clutch control.
Figure 4A:
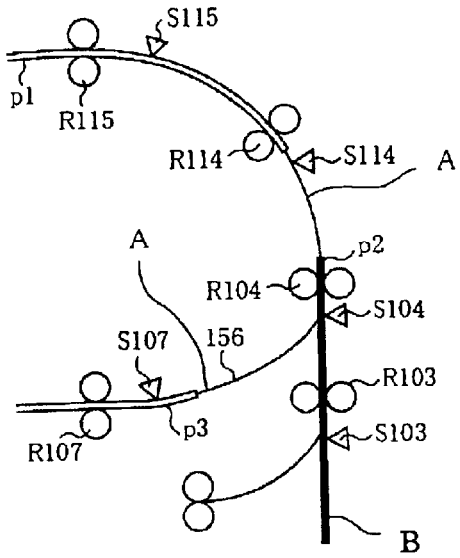
FIG. 4 is a diagram showing merger of alternatively fed sheets and sheet separation.
Figure 4C:
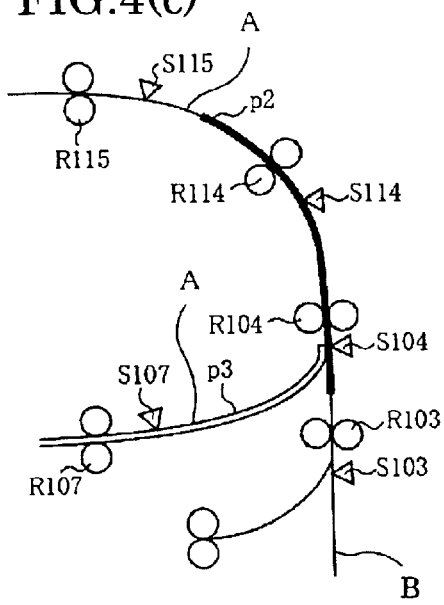
Figure 4B:
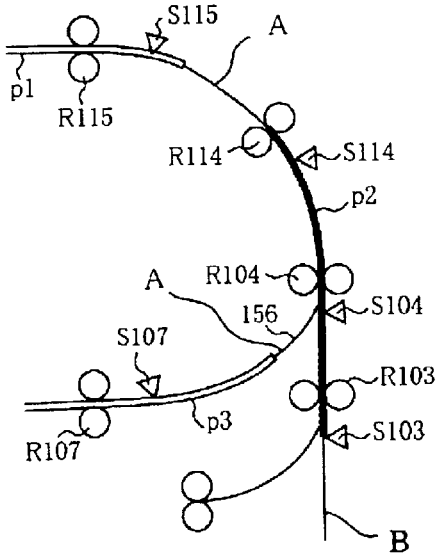
Figure 4D:
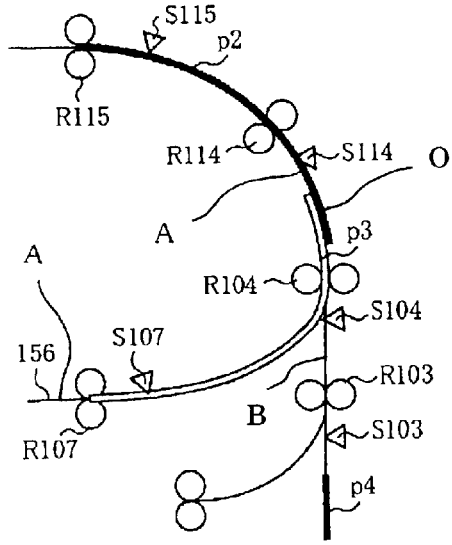
Figure 5A:
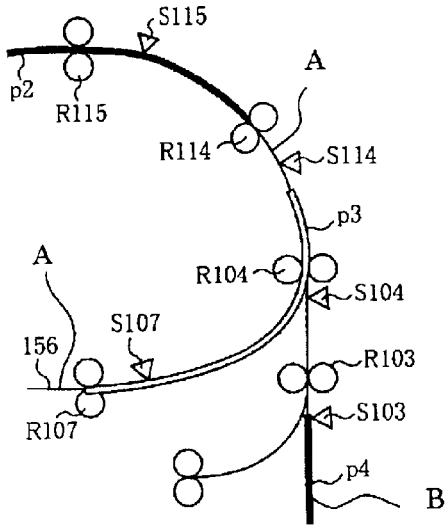
FIG. 5 is a diagram showing merger of alternatively fed sheets and sheet separation.
Figure 5C:
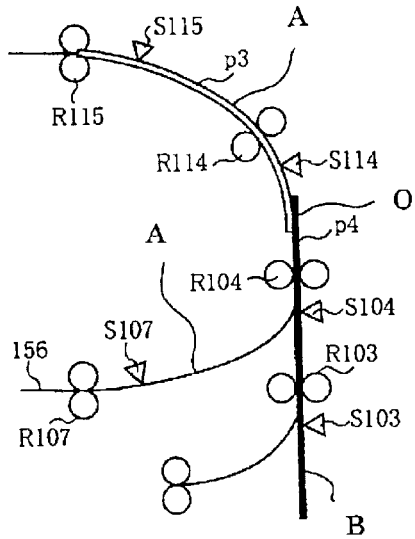
Figure 5B:
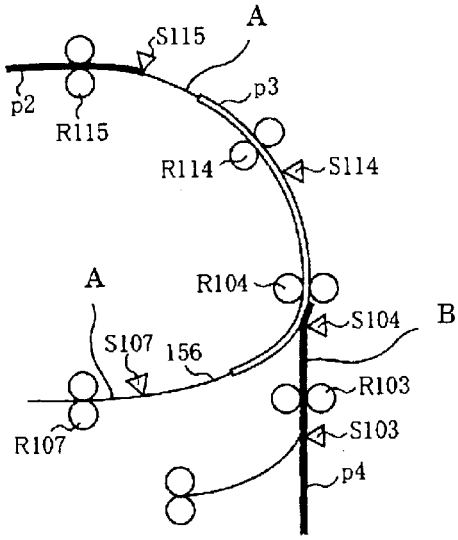
Figure 5D:
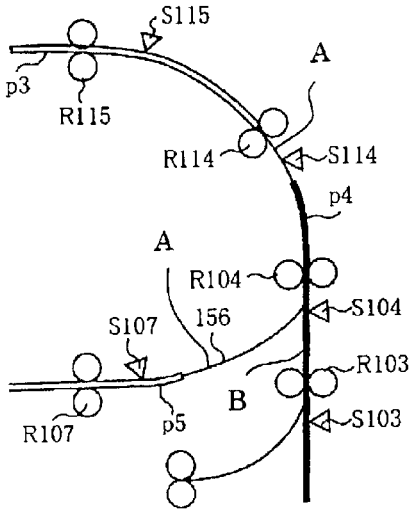
Figure 6A:
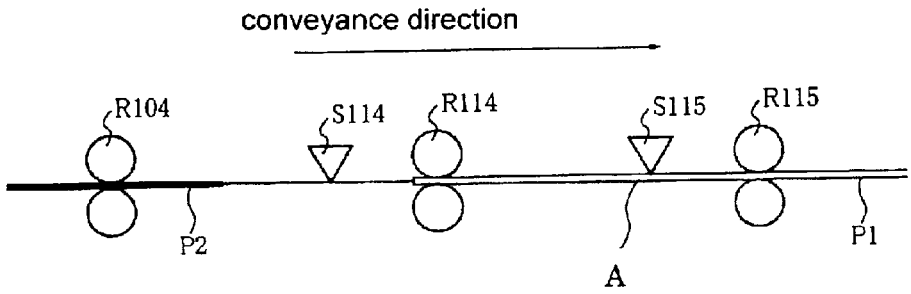
FIG. 6 is a schematic view showing separation of sheet right before a register roller.
Figure 6B:
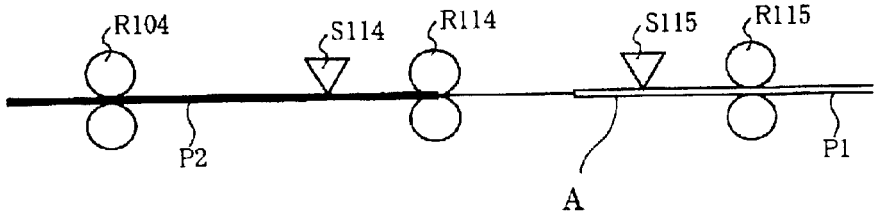
Figure 6C:
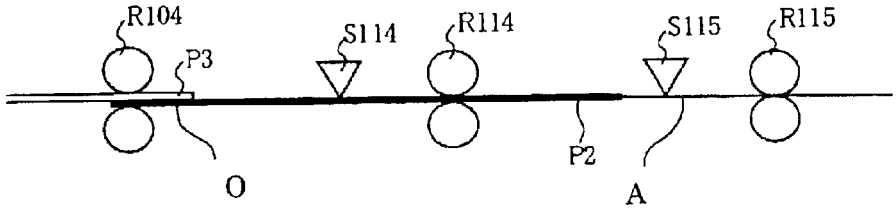
Figure 6D:
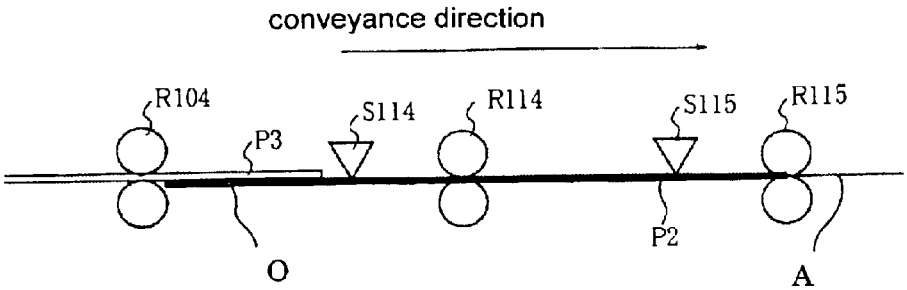
Figure 7A:
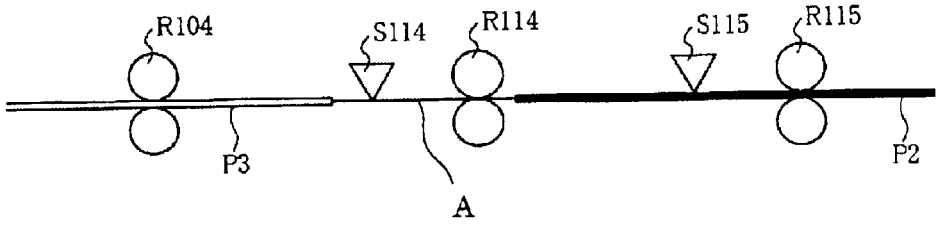
FIG. 7 is a schematic view showing separation of sheet right before a register roller.
Figure 7B:
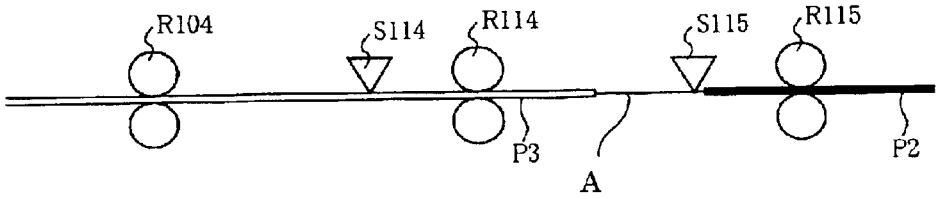
Figure 7C:
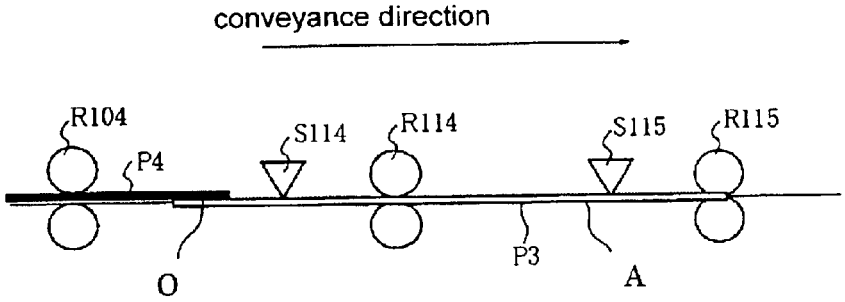
Figure 7D:
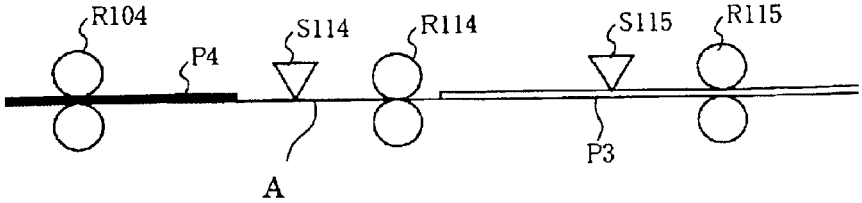

FIG. 3 is a block diagram of a clutch control relation. The output of the sensors S100 to S115, S201, S202 are inputted to a CPU 180. The CPU 180 controls drive of the motor 120 via an amplifier 186. The CPU 180, though not shown in FIG. 3, controls drive of the motors 128, 130, 122, 124, 126. The CPU 180 also controls engagements and disengagements of the clutches C100 to C115, C201, C202. The setting inputted at the controlling portion 300 is transmitted to the CPU 180, and the CPU 180 renders the controlling portion 300 display the manipulation images.

A control program performed at the CPU 180 is stored in a ROM 182 readable by the CPU 180. The program for sheet conveyance control as described below is also stored in the ROM 182. Data necessary for the control of the CPU 180 are written in a RAM 184 with a battery backup. Data measured for correction control as described below are also written in the RAM 184. Non-volatile memory such as EEPROM can be used in lieu of the RAM 184. Those rollers, sensors, and the CPU constitute sheet merging overlapping means and sheet overlapping separating means of this invention.

Referring to FIG. 4 and FIG. 5, a conveyance route structure is described in which a sheet conveyed from the double side portion through a first conveyance route A (double side path 156) merges with a sheet fed from the feeding cassette through a second conveyance route B and is sent to the register roller R115 through the first conveyance route A. Herein, the sheet merging overlapping means is constituted of a first conveyance roller R107 for feeding sheets on the first conveyance route A (double side path 156), a second conveyance roller R103 for feeding sheets on the second conveyance route B, and the CPU 180 controlling the sheets to be conveyed in a manner overlapping a part of the two sheets in use of those sensors S107, S103, S104, etc. The sheet overlapping separating means is constituted of a third conveyance roller R104 on the first conveyance route A after merging with the second conveyance route B, the conveyance roller R114, and the CPU 180 controlling drive and stop of both conveyance rollers for separating two sheets from one another in use of the sensors S115, S114.

FIG. 4 and FIG. 5 are illustrations showing a merger of sheets p2, p4 sent from the feeding cassette, and a sheet p3 fed from the double side path 156. FIG. 6 and FIG. 7 are illustrations linearly showing states between the register roller R115 and the conveyance roller R104 located on the upstream side of the register roller in the same alphabetic illustrations of FIG. 4 and FIG. 5, respectively.

In FIG. 4(*a*), the position of the sheet p3 is confirmed upon detection of the front end of the sheet p3 with the sensor S107 with respect to the sheet p2, feeding of the sheet p3 is stopped where the interval is short with respect to the merger with the sheet p2 and is resumed where the sheet interval with respect to the merger is made to a certain distance. The sheet p3 is stopped in an ordinary case because the feeding of the sheet p3 is started at a timing with a margin to allow some delay to some extent occurring where feeding is made from the double side path 156, although the interval may not be short.

FIGS. 4(*b*) to 4(*d*) are illustrations showing timings of the merger upon conveyances of the sheet p2 and the sheet p3.

FIG. 4(*d*) is an illustration showing the sheet p2 stopping at the register roller R115. The front end of the sheet p3 is located right before the roller R114, and is made to be conveyed and merged in measuring timing so as to move in front of the sensor S114 in a state as shown in FIG. 4(*a*). With this movement, the rear end of the proceeding sheet p2 is overlapped with the front end of the subsequent sheet p3, thereby forming an overlapped portion O of the sheets. The sheet 4 fed out of the feeding cassette at that time is already conveyed near the sensor S103 to be controlled to merge with the sheet p3.

FIG. 5(*a*) shows a situation in which the sheet p2 is fed by the register roller R115 and conveyed where the clutches of the conveyance roller R114 and the register roller R115 are engaged. The conveyance rollers R104, R107 are stopped at that time in holding the sheet p3 without engagement of the clutches to separate the sheet p2 and the sheet p3 from each other. Then, because the sheet p2 only is fed, the overlapping conveyance with the sheet p3 is cancelled between the conveyance roller R104 and the conveyance roller R114. When it is confirmed that the rear end of the sheet p2 goes by the sensor S114 serving as a detecting means of this invention, the conveyance of the sheet p3 is resumed. With respect to the sheet p4, the sheet is not conveyed and is stopped until a proper interval for merger is formed after the sheet p3 is resumed to be conveyed. With this manipulation, the sheets are conveyed to the register roller R115 with a prescribed intervak between the rear end of the sheet p2 and the front end of the sheet p3.

FIG. 5(*b*) shows a merger of the sheet p3 and the sheet p4 and shows, at this time, a merging state of the sheet p3 fed from the double side portion and the sheet p4 fed from the cassette. In this control, the same timing is controlled as in the control shown in FIGS. 4(*a*) to 4(*d*), and FIG. 5(*a*). Regarding FIG. 5(*c*), it is the same as FIG. 4(*d*) where the feeding portion of the fed sheets is different and no more than that. FIG. 5(*d*) also shows a state in which the rear end of the sheet p3 and the front end of the sheet p4 are conveyed with a prescribed interval.

Referring to FIG. 6 and FIG. 7, the separation work of the sheets is described. As shown in FIG. 6(*a*), work in which the first sheet p1 as the proceeding sheet is sent to the photosensitive drum 152 by the register roller R115 is made, while the second sheet p2 as the subsequent sheet is stopped, at the first conveyance route A after merging with the second conveyance route B. Where the sensor S114 located between the first conveyance roller R104 and the second conveyance roller R114 detects a gap between the first sheet p1 and the second sheet p2, the CPU 180 serving as a controlling apparatus ends the sheet's separation work as shown in FIG. 6(*b*), thereby resuming the work to feed the second sheet p2 with the first conveyance roller R104. Then, as shown in FIG. 6(*c*), the second sheet p2 and the third sheet p3 overlapping the rear end of the second sheet p2 follow this further (overlapping conveyance mode). As shown in FIG. 6(*d*), the front end of the third sheet p3 reaches the register roller R115, and where the overlapping portion O between the second sheet p2 and the third sheet p3 is located between the first conveyance roller R104 and the second conveyance roller R114, the sensor S115 detects this, and the CPU 180 stops the conveyance roller R104. Meanwhile, the second sheet p2 is conveyed by the register roller R115 in taking timing with the photosensitive drum, thereby canceling the overlapping portion with the third sheet p3 (overlapping canceling mode). Operations shown in FIGS. 7(*b*) to 7(*c*) are substantially the same as those shown in FIGS. 6(*c*), 6(*d*), and FIG. 7(*a*), and repeating those operations repeatedly separates the proceeding sheet and the subsequent sheet from each other otherwise overlapped.

The reason to use a brake clutch (clutch having an electromagnetic brake) at the roller R104 is because, according to the sheet length, the proceeding sheet may be fed forward in keeping the proceeding sheet held by the roller R104. That is, upon use of the brake clutch, where the roller R104 holds the proceeding sheet, the proceeding sheet can be pulled out by turning on the brake clutch, and the subsequent sheet can be captured. Such brake clutches are frequently used in the conveyance rollers because the sheets can be separated with substantially the same control with respect to the clutches located on the upstream side according to the sheet size length. Although in this embodiment, the sheet conveyance is made in use of the clutches, the same control can be made in the case where some stepping motor is used in lieu of the clutch, and the sheet separation is possible.

There would be no problem on speed difference used in recent image forming apparatuses because no influence is made with the control at the merger portion even where the conveyance speed is different from the image forming speed upon beginning the feeding of the register roller R115. With control of this time, the structure used so far can be also used commonly from a structural viewpoint by controlling the subsequent sheet to be clamped by rollers to be separated, in order to separate solely the subsequent sheet fed with a minus sheet interval. If there is no roller to clamp solely the subsequent sheet, various sheet size are controllable because the proceeding sheet can be pulled out in use of the brake clutch. Substantially the same control can be made upon exciting the motor even where the stepping motor is used.

It is to be noted that although in this embodiment cancellation of the overlapping state is judged in detecting, by the sensor S114, existence of the sheet at the position of the sensor S114, the cancellation of the overlapping state of the proceeding sheet and the subsequent sheet can be judged by providing a sensor measuring the moving distance of the proceeding sheet upon setting the length of the overlapping portion O. As a sensor for measuring the moving distance of the proceeding sheet, exemplified is a sensor measuring a rotation amount of the motor for rotating the fourth conveyance roller R114.

Although in the above embodiment images are formed on the proceeding sheet after the overlapping state of the proceeding sheet and the subsequent sheet is cancelled, images may be formed as the proceeding sheet overlaps the subsequent sheet where images are not necessarily formed on ends of the sheets.

Although in this embodiment, the sheet overlapping separating means controls to separate the proceeding sheet by stopping the subsequent sheet by stopping the third roller R104, this invention is not limited to this, and a control can be made in which the sheet is separated in differentiating between the conveyance speed of the proceeding sheet and the conveyance speed of the subsequent sheet by rendering faster the conveyance speed of the conveyance roller R114 than the conveyance speed of the subsequent sheet. In this control, the productivity can be improved in comparison with those controlled as to stop the sheets because the sheets are not stopped.

Although in the above embodiment the sheets are made overlapped between the first conveyance route serving as the double side path and the second conveyance route for conveying the sheets from the feeding cassette, this invention is not limited to this, and the sheets can be overlapped from the feeding cassette D109 and the feeding cassette D109 as shown in FIG. 1. That is, the proceeding sheet and the subsequent sheet can be overlapped at a portion in the conveyance direction of the sheet by controlling the timing to feed the sheet from the feeding cassette D108 and the timing to feed the sheet from the feeding cassette D109 at the merging portion of the conveyance route for conveying the sheet fed from the feeding cassette D109 and the conveyance route for conveying the sheet fed from the feeding cassette D108.

What is claimed is:

1. A sheet conveying apparatus comprising:

first conveying means for conveying a sheet;

second conveying means for conveying a sheet in merging with the first conveying means;

sheet overlapping means for overlapping, at a junction between the first and second conveying means, the sheet conveyed by the first conveying means with the sheet conveyed by the second conveying means in a sheet conveyance direction, wherein the sheets overlapped by the sheet overlapping means are conveyed by the first conveying means; and sheet overlapping separating means disposed on a downstream side of the junction for cancelling overlapping of the overlapped sheets conveyed by the first conveying means.

2. The sheet conveying apparatus according to claim 1, further comprising plural conveyance rollers arranged along a sheet conveyance direction of the first conveying means and disposed on a downstream side of the junction;

wherein the sheet overlapping separating means cancels overlapping of the overlapped sheets by a differential of a sheet conveyance speed of the plural conveyance rollers.

3. The sheet conveying apparatus according to claim 2, further comprising detecting means for detecting cancellation of overlapping the sheets by the sheet overlapping separating means, wherein the sheet conveyance speed of the plural conveyance rollers is made substantially equal based on detection of the cancellation of overlapping the sheets from the detecting means.

4. The sheet conveying apparatus according to claim 2, wherein the sheet overlapping separating means cancels overlapping of the proceeding sheet and the subsequent sheet by conveying the proceeding sheet with the conveyance roller located on a downstream side upon stopping the conveyance roller located on an upstream side among the plural conveyance rollers.

5. The sheet conveying apparatus according to claim 2, further comprising detecting means for detecting cancellation of overlapping the sheets by the sheet overlapping separating means, wherein the subsequent sheet is conveyed again by rotating the conveyance rollers located on the upstream side based on detection of the cancellation of overlapping the sheets from the detecting means.

6. An image forming apparatus comprising:

image forming means for forming an image on a sheet;

first conveying means for conveying a sheet;

second conveying means for conveying a sheet in merging with the first conveying means;

sheet overlapping means for overlapping, at a junction between the first and second conveying means, the sheet conveyed by the first conveying means with the sheet conveyed by the second conveying means in a sheet conveyance direction, wherein the sheets overlapped by the sheet overlapping means are conveyed by the first conveying means; and sheet overlapping separating means disposed on a downstream side of the junction for canceling overlapping of the overlapped sheets conveyed by the first conveying means.

7. The image forming apparatus according to claim 6, further comprising sheet containing means for containing a sheet to be fed to the image forming means, wherein the first conveying means conveys the sheet fed from the sheet containing means to the image forming means, wherein the second conveying means conveys the sheet on which an image is formed from the junction to the image forming means, and wherein the sheet overlapping means overlaps the sheet conveyed from the sheet containing means with the sheet conveyed by the second conveying mean in the conveyance direction of the sheets at the junction.

8. The image forming apparatus according to claim 6, further comprising a plurality of sheet containing means for containing a sheet to be fed to the image forming means, wherein the first conveying means conveys the sheet fed from one of the sheet containing means to the image forming means, wherein the second conveying means conveys the sheet fed from another of the sheet containing means to the junction, and wherein the sheet overlapping means overlaps the sheets conveyed from the respective sheet containing means in the conveyance direction of the sheets at the junction.

9. The image forming apparatus according to claim 6, further comprising plural conveyance rollers arranged along a sheet conveying direction and disposed on a downstream side of the junction;

wherein the sheet overlapping separating means cancels overlapping of the overlapped sheets by a differential of a sheet conveyance speed of the plural conveyance rollers.

10. The image forming apparatus according to claim 9, further comprising detecting means for detecting cancellation of overlapping the sheets by the sheet overlapping separating means, wherein the sheet conveyance speed of the plural conveyance rollers is made substantially equal based on detection of the cancellation of overlapping the sheets from the detecting means.

11. The image forming apparatus according to claim 9, wherein the sheet overlapping separating means cancels overlapping of the proceeding sheet and the subsequent sheet by conveying the proceeding sheet with the conveyance roller located on a downstream side upon stopping the conveyance roller located on an upstream side among the plural conveyance rollers.

12. The image forming apparatus according to claim 11, further comprising a detecting means for detecting cancellation of overlapping the sheets by the sheet overlapping separating means, wherein the subsequent sheet is conveyed again by rotating the conveyance rollers located on the upstream side based on detection of the cancellation of overlapping the sheets from the detecting means.

13. A sheet conveying apparatus comprising:

a first conveyance route;

a first conveyance roller disposed on the first route;

a second conveyance route which merges into the first conveyance route at a junction between the first and second conveyance routes;

a second conveyance roller disposed on the first conveyance route;

plural conveyance rollers arranged along a sheet conveyance direction of the first conveyance route and disposed on a downstream side of the junction; and a controller;

wherein the controller so controls the drive of the first and second conveyance rollers as to convey the sheets in overlapping, at the junction, the sheet conveyed by the first conveyance roller with the sheet conveyed by the second conveyance roller in a sheet conveyance direction, wherein the sheets overlapped by the first and second conveyance rollers are conveyed on the first conveyance route, and then, wherein the controller controls the plural conveyance rollers so that overlapping of the overlapped sheets is cancelled.

* * * * *

UNITED STATES PATENT AND TRADEMARK OFFICE

CERTIFICATE OF CORRECTION

PATENT NO. : 6,836,640 B2
APPLICATION NO. : 10/315028
DATED : December 28, 2004
INVENTOR(S) : Keizo Isemura et al.

It is certified that error appears in the above-identified patent and that said Letters Patent is hereby corrected as shown below:

COLUMN 1:
Line 15, “the sheets fed” should read --at a time when the sheets are being fed--.
Line 22, “proceeding” should read --preceding--.
Line 45, “proceeding” should read --preceding--.
Line 56, “alternatively” should read --alternately--.
Line 60, “feeding” should read --feeds--.

COLUMN 2:
Line 18, “proceeding” should read --preceding--.
Line 28, “proceeding” should read --preceding--.
Line 32, “proceeding” should read --preceding--.
Line 33, “proceeding” should read --preceding--.
Line 44, “alternatively” should read --alternating--.
Line 46, “alternatively” should read --alternating--.

COLUMN 3:
Line 8, “rendering the scanner 310 read” should read --causing scanner 310 to read--.
Line 15, “aside” should read --a side--.
Line 47, “Formed” should read --provided--.

COLUMN 4:
Line 22, “waiting” should read --awaiting--.
Line 28, “up” should read --up to--.

COLUMN 5:
Line 19, “proceeding” should read --preceding--.

COLUMN 6:
Line 44, “renders” should read --causes--.
Line 45, “display” should read --to display--.

COLUMN 7:
Line 20, “to a” should read --to be a--.
Line 33, “proceeding” should read --preceding--.
Line 55, “intervak” should read --interval--.

UNITED STATES PATENT AND TRADEMARK OFFICE

CERTIFICATE OF CORRECTION

PATENT NO. : 6,836,640 B2
APPLICATION NO. : 10/315028
DATED : December 28, 2004
INVENTOR(S) : Keizo Isemura et al.

It is certified that error appears in the above-identified patent and that said Letters Patent is hereby corrected as shown below:

COLUMN 8:
Line 3, “proceeding” should read --preceding--.
Line 28, “proceeding” should read --preceding--.
Line 32, “proceeding” should read --preceding--.
Line 33, “proceeding” should read --preceding--.
Line 35, “proceeding” (both occurrences) should read --preceding--.
Line 42, “is made in” should read --makes--.
Line 56, “size” should read --sizes--.
Line 57, “proceeding” should read --preceding--.
Line 65, “proceeding” should read --preceding--.
Line 67, “proceeding” should read --preceding--.

COLUMN 9:
Line 2, “proceeding” should read --preceding--.
Line 5, “proceeding” should read --preceding--.
Line 6, “proceeding” should read --preceding--.
Line 7, “proceeding” should read --preceding--.
Line 11, “proceeding” should read --preceding--.
Line 15, “proceeding” should read --preceding--.
Line 28, “proceeding” should read --preceding--.

COLUMN 10:
Line 5, “proceeding” should read --preceding--.
Line 6, “proceeding” should read --preceding--.

UNITED STATES PATENT AND TRADEMARK OFFICE

CERTIFICATE OF CORRECTION

PATENT NO. : 6,836,640 B2
APPLICATION NO. : 10/315028
DATED : December 28, 2004
INVENTOR(S) : Keizo Isemura et al.

It is certified that error appears in the above-identified patent and that said Letters Patent is hereby corrected as shown below:

COLUMN 11:
Line 9, “proceeding” should read --preceding--.
Line 10, “proceeding” should read --preceding--.

Signed and Sealed this

Twenty-ninth Day of May, 2007

JON W. DUDAS
*Director of the United States Patent and Trademark Office*